US010773417B2

(12) United States Patent
Peng et al.

(10) Patent No.: US 10,773,417 B2
(45) Date of Patent: *Sep. 15, 2020

(54) METHOD FOR PROCESSING A MOLDED TRAY BASED ON BAMBOO-WOOD MIXED SHAVINGS

(71) Applicant: Hangzhou Penno Packtech Co., LTD, Hangzhou (CN)

(72) Inventors: Jianwei Peng, Hangzhou (CN); Huizhen Jiang, Hangzhou (CN)

(73) Assignee: HANGZHOU PENNO PACKTECH CO., LTD, Hangzhou (CN)

( * ) Notice: Subject to any disclaimer, the term of this patent is extended or adjusted under 35 U.S.C. 154(b) by 226 days.

This patent is subject to a terminal disclaimer.

(21) Appl. No.: 15/960,936

(22) Filed: Apr. 24, 2018

(65) Prior Publication Data

US 2018/0361616 A1 Dec. 20, 2018

(30) Foreign Application Priority Data

Jun. 14, 2017 (CN) ..... 2017 1 0449163

(51) Int. Cl.

| | |
|---|---|
| ***B27N 1/02*** | (2006.01) |
| ***B27N 3/14*** | (2006.01) |
| ***B24B 9/18*** | (2006.01) |
| ***B27N 3/00*** | (2006.01) |
| ***B27N 3/18*** | (2006.01) |

(52) U.S. Cl.

CPC ..... *B27N 1/0227* (2013.01); *B24B 9/18* (2013.01); *B27N 3/007* (2013.01); *B27N 3/14* (2013.01); *B27N 1/02* (2013.01); *B27N 3/18* (2013.01)

(58) Field of Classification Search

CPC . B27N 5/00; B27N 3/18; B27N 71/02; B27N 3/10; B27N 1/02; B27N 1/0227; B27N 3/007; B27N 3/14; B27L 11/02; B24B 9/18; B27K 9/002

See application file for complete search history.

(56) References Cited

U.S. PATENT DOCUMENTS

2017/0259454 A1* 9/2017 Fujii ..... B27N 1/00

FOREIGN PATENT DOCUMENTS

| | | | |
|---|---|---|---|
| CN | 1974155 A | * | 6/2007 |
| CN | 103009453 A | * | 4/2013 |
| CN | 103522386 A | * | 1/2014 |
| CN | 105108868 A | * | 12/2015 |
| CN | 105291242 A | * | 2/2016 |
| CN | 205766688 U | * | 12/2016 |

OTHER PUBLICATIONS

Machine translation for CN 105291242 (Year: 2019).*
Machine translation for CN 205766688 (Year: 2019).*
Machine translation for CN 1974155 (Year: 2019).*
Machine translation for CN 103009453 (Year: 2019).*
Machine translation for CN 103522386 (Year: 2019).*
Machine translation for CN 105108868 (Year: 2019).*

* cited by examiner

*Primary Examiner* — Leith S Shafi
*Assistant Examiner* — Inja Song
(74) *Attorney, Agent, or Firm* — Jiangqiong Liu

(57) ABSTRACT

The present invention provides a method for processing a molded tray based on bamboo-wood mixed shavings, comprising: extracting, crushing, mixing, drying, separating by wind separation, heat balance treatment, mixing glue, paving and hot pressing, cooling and grinding, inspecting and warehousing. In the invention, the industrial trays are manufactured by mixed bamboo and wood materials. The bamboo materials do not include bamboo peels and other impurities. The use of bamboo materials can improve the quality of trays from raw materials and reduce the moisture content of the trays. In addition, the brittleness of bamboo materials can improve the hardness of trays. The combined bamboo materials and wood materials can increase the toughness of the product and reduce the cost; furthermore, each link in the production process is elaborately designed and adjusted in the invention. The industrial trays made by the processing method of the present invention have increased the weight supporting capacity by at least 1.5 times compared to ordinary trays, and the product's service life is 3 to 5 years in normal uses (no water soaking, no overpressure).

1 Claim, No Drawings

METHOD FOR PROCESSING A MOLDED TRAY BASED ON BAMBOO-WOOD MIXED SHAVINGS

RELATED APPLICATIONS

This application claims priority to Chinese Patent Application No. 201710449163.1, filed on Jun. 14, 2017.

FIELD OF THE INVENTION

The present invention relates to a manufacturing method of a molded tray.

BACKGROUND

Industrial molded trays are usually made of inexpensive and easily available waste materials. Due to the poor working environment, high using frequency and high risk of damage, molded trays are consumable industrial products, so manufacturers usually pursue for low costs by producing in batches in the production process, and overlook the product quality. As a result, some tray products that have a very low price but have a low defective rate and a very short life cycle often appear on the markets, although the cost of a single tray is reduced, actually the using costs caused by poor quality are dramatically increased. In addition, the frequent replacement of tray products will bring great inconvenience to transportation and warehousing, for example, many products have poor strength and stability because the moisture contents of raw material and process in the production process are not well controlled.

When subjected to a certain pressure, they often do not have the required pressure-bearing properties during the storage and transportation. Bamboo shaving materials are common in Jiangsu and Zhejiang, and the raw materials have stable quality. The mixed bamboo materials and wood materials have their respective advantages, to achieve a better effect.

SUMMARY

The present invention is to provide a method for processing a molded tray based on bamboo-wood mixed shavings. The processing method uses the mixture of bamboo shavings and wood shavings as raw materials, to produce durable tray products that have reliable quality, excellent performance and low costs.

To achieve the above object, the present invention adopts the following technical solutions:

A method for processing a molded tray based on bamboo-wood mixed shavings, comprising the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%. The quasi-rotted materials refer to the materials with a rot surface area of more than 40% but no rot inside the surface.

Although this part of materials has low rot degree, due to rotted material on the surface and high surface water content, it is easy to cause impact on other materials, to accelerate the overall rot speed. Therefore, they must be eliminated absolutely;

(2) Crushing: deliver the extracted bamboo materials to a crusher to crush into bamboo material segments with a length of no more than 5 cm, and then shave with a shaving machine to form bamboo shavings having length <30 mm, width <4 mm, and thickness <1.5 mm; cut the extracted wood materials into segments, with a length of no more than 10 cm, a width and a thickness of no more than 5 cm, cut the segments into wood shavings having length <30 mm, width <4 mm, and thickness <1.5 mm. Firstly cut before crushing the materials, to easily form bamboo shavings of desired size. The key for molding of bamboo shavings is to cut as thin as possible, by this way, the time to achieve an ideal effect can be shortened in the subsequent steps of drying and heat balance treatment;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 30 rpm using a stirring rod without sharp portion, to avoid breaking shavings into powder. Continue the blowing and stirring for 8-10 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of not less than 35 cm. The stacking thickness of mixed shavings in each tray does not exceed 3 cm, the drying temperature is maintained at 160-170° C., the drying time is 15-25 min, and the moisture content of mixed shavings after drying does not exceed 1% in mass percent. The moisture content of the bamboo products is lower than that of the wood products, and not easy to absorb water as wood products, so the bamboo products and wood products are mixed, which can not only maintain the low cost and high hardness of the wood products, but also have the brittleness and dryness of bamboo products. The trays made by mixed materials can better guarantee the quality;

(5) Separating by wind separation: The dried mixed shavings are subjected to secondary purification by cyclone separation and pulse dust removal, to remove the bamboo scraps and impurities, to get mixed shaving materials with a mass purity greater than 98% after separation. The bamboo material itself has fewer impurities; after the secondary purification and impurity removal, it is basically free of impurities, to achieve a high purity. It can averagely remove the impurities of the wood materials, which is very good for the subsequent tray production;

(6) Heat balance treatment: place mixed shaving materials with a mass purity greater than 99% in a confined space in batches, with a thickness of each batch of no more than 5 cm, and a volume of each batch of no more than 0.5 cubic meter. Mixed shavings are placed as loosely as possible, the density of mixed shavings of each batch does not exceed 0.06 g/cm$^3$, and the spacing between each batch of mixed shavings does not exceed 20 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 5 to 8 minutes, and the quantity for each heat-balance treatment is not less than 50 batches of mixed shavings.

The heat balance treatment is a very important step in the processing method of the present invention because different batches of mixed shaving materials cannot be guaranteed to have the same moisture content and basal temperature after separated and dried, even for the same batch of mixed shaving materials; due to different positions during the processing, for example, in the drying step, the materials of the outer layer are closer to the drying sources, the degree of drying may be higher, the basal temperature will be higher, but the materials of the inner layer, especially in the middle part of the materials, are less irradiated by the drying source, so the drying degree is obviously not as good as the outer layer materials, and accordingly, the basal temperature is also lower. In ordinary processing steps, if the heat balance treatment is not carried out, the difference of moisture content and the basal temperature between materials will not be considered. However, in the actual production process, even if the moisture content different is extremely small, it may produce great influence on overall quality of the product in the subsequent steps, because the production of trays need high pressure to press the base material of tray into a material with high density, and the difference that cannot be reflected in the state may be amplified in the molding process. For example, if the moisture content of the material in different parts is different, the materials of high moisture content may be pressed to the surrounding materials with low moisture content when mold pressing, at this time, the moisture will be different from the original moisture in the material, causing permanent damage to the material and reducing the strength of the material. Under the high pressure of molding, if the moisture is not uniform, or the heat is not uniform, it is very possible to generate steam or bubbles in a place with high heat or high moisture, at this time, bubbles cannot be removed from the product. Obviously, bubbles will cause the formation of pores inside the product, and the strength of the pores will be greatly reduced, which will produce a fundamental impact on product strength and density, and this impact cannot be eliminated. Therefore, if the materials are not put together for heat balance, the quality of raw materials will be different, and it is unable to guarantee the consistency in the quality of the finished products. Through the heat balance steps, the moisture content and basal temperature of more wood materials will be close for the same batch. For example, for a batch of mixed shavings, after the above steps, the basal temperature of the semi-finished products is 25° C., the moisture content is 2%, while the basal temperature of the another batch of semi-finished products is 20° C. and the moisture content is 1%. After the heat balance treatment, the temperature of the two batches of semi-finished products can be reduced to the temperature of the heat balance processing space (room temperature 15-20° C.), and the moisture content is balanced due to the air circulation. Usually, after standing for a period of time, the moisture content of the two batches of semi-finished products can reach an average value of 1.5%. If the moisture content still cannot meet the requirements, dehumidification can be performed in a standing space if necessary. Usually it is carried out by putting some materials with adsorption properties or using dehumidifiers;

(7) Mixing glue: Feed mixed shavings and glues to a mixer at a volume ratio of 1:0.2-0.25, and stir 3 minutes at a stirring speed of 100-200 rpm. The stirring quantity for 3 minutes each time does not exceed 80 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved. The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(9) Cooling and grinding: take out workpieces from the mold after pressure relief, and place to a rack for cooling. The rack is placed in a room temperature ventilation room, to avoid water. The indoor air humidity is not more than 35%, and if the air humidity is too high, dehumidify and then place the workpieces. The rack is a high-temperature resistant multi-layer bracket. The spacing between each layer of brackets is not less than 48 cm and the spacing between adjacent racks is not less than 30 cm. The cooling time is 1-2 days, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

The present invention can achieve the following beneficial effects. The mixed bamboo materials and wood materials are used to process the industrial trays. The bamboo materials do not include impurities such as bamboo peels. The use of bamboo materials can improve the quality of trays from raw materials and reduce the moisture content of the trays. In addition, the brittleness of bamboo materials can improve the hardness of trays. The combined bamboo materials and wood materials can increase the toughness of the product and reduce the cost; furthermore, each link in the production process is elaborately designed and adjusted in the invention; based on inventor's long-term practice and experimentation, the inventor firstly proposes to add a heat balance treatment in the preparation step to allow the moisture content and basal temperature of raw materials to be basically the same, thereby avoiding different product performance in the mold pressing process caused by different moisture content and basal temperature in the subsequent steps, resulting in the decreased product density and strength. In the present invention, every step from the extraction and processing of raw materials to the processing of raw materials has been simplified to achieve the best treatment effect, and the entire processing process will not significantly increase the processing cost and the processing time, but it greatly improves the processing quality. Industrial trays made by the processing method of the present invention have increased the weight supporting capacity by at least 1.5 times compared to ordinary trays and the product's service life is 3 to 5 years in normal uses (no water soaking, no overpressure).

DETAILED DESCRIPTION

Example 1

A method for processing a molded tray in this embodiment comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 5 cm, and then shave with a shaving machine to form bamboo shavings having length of 29 mm, width of 3.5 mm and thickness of 1.4 mm; cut the extracted wood materials into segments, with a length of 10 cm, a width and a thickness of 5 cm, cut the segments into wood shavings having length of 29 mm, width of 3.5 mm and thickness of 1.4 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 30 rpm using a stirring rod without sharp portion, continue the blowing and stirring for 8 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 38 cm. The stacking thickness of mixed shavings in each tray is 2.5 cm, the drying temperature is maintained at 160° C., the drying time is 25 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 97%; (6) Heat balance treatment: place mixed shaving materials with a mass purity of 97% in a confined space in batches, with a thickness of each batch of 5 cm, and a volume of each batch of 0.5 cubic meters. Mixed shavings are placed as loosely as possible, the density of mixed shavings of each batch is 0.055 g/cm$^3$, and the spacing between each batch of mixed shavings is 20 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 5 minutes, and the quantity for each heat-balance treatment is 50 batches of mixed shavings;

(7) Mixing glue: Feed mixed shavings and glues to a mixer at a volume ratio of 1:0.2, and stir 3 minutes at a stirring speed of 100 rpm. The stirring quantity for 3 minutes each time is 80 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved.

The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(9) Cooling and grinding: take out workpieces from the mold after pressure relief, and place to a rack for cooling. The rack is placed in a room temperature ventilation room, to avoid water. The indoor air humidity is not more than 35%, and if the air humidity is too high, dehumidify and then place the workpieces. The rack is a high-temperature resistant multi-layer bracket. The spacing between each layer of brackets is 48 cm and the spacing between adjacent racks is 30 cm. The cooling time is 1 day, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

Example 2

A method for processing a molded tray in this embodiment comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 4.5 cm, and then shave with a shaving machine to form bamboo shavings having length of 28 mm, width of 3 mm and thickness of 1.2 mm; cut the extracted wood materials into segments, with a length of 9 cm, a width and a thickness of 4.5 cm, cut the segments into wood shavings having length of 28 mm, width of 3 mm and thickness of 1.2 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 25 rpm using a stirring rod without sharp portion, continue the blowing and stirring for 10 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 40 cm. The stacking thickness of mixed shavings in each tray is 2 cm, the drying temperature is maintained at 165° C., the drying time is 28 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 97%;

(6) Heat balance treatment: place mixed shaving materials with a mass purity greater than 97% in a confined space in batches, with a thickness of each batch of 4 cm, and a volume of each batch of 0.5 cubic meters. Mixed shavings are placed as loosely as possible, the density of mixed shavings of each batch is 0.05 g/cm$^3$, and the spacing between each batch of mixed shavings is 15 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 6 minutes, and the quantity for each heat-balance treatment is 60 batches of mixed shavings;

(7) Mixing glue: Feed mixed shavings and glues to a mixer at a volume ratio of 1:0.25, and stir 3 minutes at a stirring speed of 200 rpm. The stirring quantity for 3 minutes each time is 75 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved.

The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(9) Cooling and grinding: take out workpieces from the mold after pressure relief, and place to a rack for cooling. The rack is placed in a room temperature ventilation room, to avoid water. The indoor air humidity is not more than 35%, and if the air humidity is too high, dehumidify and then place the workpieces. The rack is a high-temperature resistant multi-layer bracket. The spacing between each layer of brackets is 50 cm and the spacing between adjacent racks is 32 cm. The cooling time is 1 day, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

Example 3

A method for processing a molded tray in this embodiment comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 3 cm, and then shave with a shaving machine to form bamboo shavings having length of 25 mm, width of 3 mm and thickness of 1 mm; cut the extracted wood materials into segments, with a length of 8 cm, a width and a thickness of 3 cm, cut the segments into wood shavings having length of 25 mm, width of 3 mm and thickness of 1 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 25 rpm using a stirring rod without sharp portion, continue the blowing and stirring for 9 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 42 cm. The stacking thickness of mixed shavings in each tray is 1.8 cm, the drying temperature is maintained at 170° C., the drying time is 28 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 98%;

(6) Heat balance treatment: place mixed shaving materials with a mass purity greater than 98% after separation in a confined space in batches, with a thickness of each batch of 3.5 cm, and a volume of each batch of 0.5 cubic meters. Mixed shavings are placed as loosely as possible, the density of mixed shavings of each batch is 0.04 g/cm$^3$, and the spacing between each batch of mixed shavings is 15 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 5 minutes, and the quantity for each heat-balance treatment is 50 batches of mixed shavings;

(7) Mixing glue: Feed mixed shavings and glues to a mixer at a volume ratio of 1:0.22, and stir 3 minutes at a stirring speed of 180 rpm. The stirring quantity for 3 minutes each time is 78 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved. The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(9) Cooling and grinding: take out workpieces from the mold after pressure relief, and place to a rack for cooling. The rack is placed in a room temperature ventilation room, to avoid water. The indoor air humidity is 35%, and if the air humidity is too high, dehumidify and then place the workpieces. The rack is a high-temperature resistant multi-layer bracket. The spacing between each layer of brackets is 52 cm and the spacing between adjacent racks is 33 cm. The cooling time is 2 days, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

Comparative Example 1

A method for processing a molded tray in this comparative example 1 comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 3 cm, and then shave with a shaving machine to form bamboo shavings having length of 25 mm, width of 3 mm and thickness of 1 mm; cut the extracted wood materials into segments, with a length of 8 cm, a width and a thickness of 3 cm, cut the segments into wood shavings having length of 25 mm, width of 3 mm and thickness of 1 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 25 rpm using a stirring rod without sharp portion, continue the blowing and stirring for 9 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 42 cm. The stacking thickness of mixed shavings in each tray is 1.8 cm, the drying temperature is maintained at 170° C., the drying time is 28 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 98%;

(6) Mixing glue: Feed mixed shavings and glues to a mixer at a volume ratio of 1:0.22, and stir 3 minutes at a stirring speed of 180 rpm. The stirring quantity for 3 minutes each time is 78 kg, and materials after stirring are put into a bucket for standby;

(7) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved. The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(8) Cooling and grinding: take out workpieces from the mold after pressure relief, and place to a rack for cooling. The rack is placed in a room temperature ventilation room, to avoid water. The indoor air humidity is 35%, and if the air humidity is too high, dehumidify and then place the workpieces. The rack is a high-temperature resistant multi-layer bracket. The spacing between each layer of brackets is 52 cm and the spacing between adjacent racks is 33 cm. The cooling time is 2 days, after cooling, the workpieces are delivered to an automatic edge grinding machine for grinding, and the edge grinding is required to remove or flatten the spiked portion of the workpiece edge;

(9) Inspecting and warehousing: Inspect the workpieces after grinding, including hardness, moisture content, edge roughness, and shape. Unqualified products are removed according to the finished product requirements. Qualified products are stacked in batches according to the required quantity.

Comparative Example 2

A method for processing a molded tray in this embodiment comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 3 cm, and then shave with a shaving machine to form bamboo shavings having length of 25 mm, width of 3 mm and thickness of 1 mm; cut the extracted wood materials into segments, with a length of 8 cm, a width and a thickness of 3 cm, cut the segments into wood shavings having length of 25 mm, width of 3 mm and thickness of 1 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 25 rpm using a stirring rod without sharp portion, continue the blowing and stirring for 9 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 42 cm. The stacking thickness of mixed shavings in each tray is 1.8 cm, the drying temperature is maintained at 170° C., the drying time is 28 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 98%;

(6) Heat balance treatment: place mixed shaving materials with a mass purity greater than 98% after separation in a confined space in batches, with a thickness of each batch of 3.5 cm, and a volume of each batch of 0.5 cubic meters. Mixed shavings are placed as loosely as possible, the density of mixed shavings of each batch is 0.04 g/cm$^3$, and the spacing between each batch of mixed shavings is 15 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 3 minutes, and the quantity for each heat-balance treatment is 50 batches of mixed shavings;

(7) Mixing glue: Feed mixed shavings and glues to a mixer at a volume ratio of 1:0.22, and stir 3 minutes at a stirring speed of 180 rpm. The stirring quantity for 3 minutes each time is 78 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved. The pressure relief refers to the process of reducing the pressure from the holding pressure to zero and the time of pressure relief is 90 seconds. Carry out cooling while relieving the pressure, and when the pressure relieving is finished, the temperature is dropped to less than 100° C.;

(9) Cooling and grinding: take out workpieces from the mold after pressure relief, and place to a rack for cooling. The rack is placed in a room temperature ventilation room, to avoid water. The indoor air humidity is 35%, and if the air humidity is too high, dehumidify and then place the workpieces. The rack is a high-temperature resistant multi-layer bracket. The spacing between each layer of brackets is 52 cm and the spacing between adjacent racks is 33 cm. The cooling time is 2 days, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

Comparative Example 3

A method for processing a molded tray in this embodiment comprises the following steps:

(1) Extracting: collect scrap bamboo processing materials, remove bamboo peels and other impurities, and remove rotted or quasi-rotted bamboo materials with a moisture content of greater than 20%; collect scrap wood processing materials, remove impurities other than woods, and remove rotted or quasi-rotted wood materials with a with a moisture content of greater than 20%;

(2) Crushing: deliver the extracted bamboo materials to a crusher to crush into bamboo material segments with a length of 3 cm, and then shave with a shaving machine to form bamboo shavings having length of 25 mm, width of 3 mm and thickness of 1 mm; cut the extracted wood materials into segments, with a length of 8 cm, a width and a thickness of 3 cm, cut the segments into wood shavings having length of 25 mm, width of 3 mm and thickness of 1 mm;

(3) Mixing: Perform physical mixing of the crushed bamboo shavings and wood shavings at a mass ratio of 1:1, and the mixing process is to put the mixed materials into a container, blow air to the container, and at the same time, stir the materials at a speed of 25 rpm using a stirring rod without sharp portion, continue the blowing and stirring for 9 minutes, so that bamboo shavings and wood shavings are evenly stirred;

(4) Drying: Loosely put the mixed shaving materials into a tray that is resistant to high temperature and poor in thermal conductivity, then dry in a drying oven. Place the trays by layers in a drying oven, with a distance between two adjacent trays of 42 cm. The stacking thickness of mixed shavings in each tray is 1.8 cm, the drying temperature is maintained at 170° C., the drying time is 28 min, and the moisture content of mixed shavings after drying is 1% in mass percent;

(5) Separating by wind separation: The dried mixed shavings are subjected to secondary purification by cyclone separation and pulse dust removal, to remove the metal materials, gravels, coarse wood materials, and impurities and powders in the bamboo products, to get mixed shaving materials with a mass purity of 98%;

(6) Heat balance treatment: place mixed shaving materials with a mass purity greater than 98% after separation in a confined space in batches, with a thickness of each batch of 3.5 cm, and a volume of each batch of 0.5 cubic meters. Mixed shavings are placed as loosely as possible, the density of mixed shavings of each batch is 0.04 g/cm$^3$, and the spacing between each batch of mixed shavings is 15 cm, to facilitate the exchange of heat and moisture between each batch of mixed shavings. Multiple batches of mixed shavings that are left at room temperature are subjected to heat balance treatment through the internal circulation of air in a confined space. The time for each heat-balance treatment is 10 minutes, and the quantity of each heat-balance treatment is 50 batches of mixed shavings;

(7) Mixing glue: Feed mixed shavings and glues to a mixer at a volume ratio of 1:0.22, and stir 3 minutes at a stirring speed of 180 rpm. The stirring quantity for 3 minutes each time is 78 kg, and materials after stirring are put into a bucket for standby;

(8) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 MPa, after the initial pressing, maintain hot pressing for 70 seconds at a pressure of 5 MPa, at the end of pressure holding, the pressure is relieved. The pressure relief refers to the process of reducing the pressure from the holding pressure to zero and the time of pressure relief is 90 seconds. Carry out cooling while relieving the pressure, and when the pressure relieving is finished, the temperature is dropped below 100° C.;

(9) Cooling and grinding: take out workpieces from the mold after pressure relief, and place to a rack for cooling. The rack is placed in a room temperature ventilation room, to avoid water. The indoor air humidity is 35%, and if the air humidity is too high, dehumidify and then place the workpieces. The rack is a high-temperature resistant multi-layer bracket. The spacing between each layer of bracket is 52 cm and the spacing between adjacent racks is 33 cm. The cooling time is 2 days, after cooling, the workpieces are delivered to an automatic edge grinding machine for grinding, and the edge grinding is required to remove or flatten the spiked portion of the workpiece edge;

(10) Inspecting and warehousing: Inspect the workpieces after grinding, including hardness, moisture content, edge roughness, and shape. Unqualified products are removed according to the finished product requirements. Qualified products are stacked in batches according to the required quantity.

Comparative Example 4

A method for processing a molded tray based on bamboo shavings, comprising the following steps:

(1) Extracting: collect scrap bamboo processing materials, remove bamboo peels and other impurities, and remove rotted or quasi-rotted bamboo materials with a moisture content of greater than 20%. The quasi-rotted wood materials refer to the materials with a rot surface area of more than 40% but no rot inside the surface. Although this part of wood materials has low rot degree, due to rotted material on the surface and high surface water content, it is easy to cause impact on other wood materials, to accelerate the overall rot speed. Therefore, they must be eliminated absolutely;

(2) Crushing: deliver the extracted materials to a crusher to crush into bamboo material segments with a length of no more than 5 cm, and then shave with a shaving machine to form bamboo shavings having length of 29 cm, width of 3.8 mm and thickness of 1.4 mm. Firstly cut before crushing the materials, to easily form bamboo shavings of desired size. The key for molding of bamboo shavings is to cut as thin as possible, by this way, the time to achieve an ideal effect can be shortened in the subsequent steps of drying and heat balance treatment;

(3) Drying: Loosely put the bamboo shavings into a tray that is resistant to high temperature and poor in thermal conductivity, then dry in a drying oven. Place the trays by layers in a drying oven, with a distance of two adjacent trays of 40 cm. The stacking thickness of bamboo shavings in each tray is 3 cm, the drying temperature is maintained at 160° C., the drying time is 15 min, and the moisture content of wood shavings after drying is 1% in mass percent. The moisture content of the bamboo products is lower than that of the wood products, and not easy to absorb water as wood products, so the industrial trays made by bamboo products can guarantee the quality of trays. In addition, the bamboo products easily achieve the moisture content of less than 1% after drying;

(4) Separating by wind separation: The dried bamboo shavings are subjected to secondary purification by cyclone separation and pulse dust removal, to remove the bamboo scraps and impurities, to get bamboo shaving materials with a mass purity greater than 99% after separation. The bamboo material itself has fewer impurities; after the secondary purification and impurity removal, it is basically free of impurities, to achieve a high purity, which is very good for the subsequent tray production;

(5) Heat balance treatment: place bamboo shaving materials with a mass purity of 99% in a confined space in batches, with a thickness of each batch of no more than 5 cm, and a volume of each batch of no more than 0.5 cubic meters. Bamboo shavings are placed as loosely as possible, the density of bamboo shavings of each batch is 0.06 g/cm$^3$, and the spacing between each batch of bamboo shavings is 20 cm, to facilitate the exchange of heat and moisture between each batch of bamboo shavings. Multiple batches of bamboo shavings that are left at room temperature are subjected to heat balance treatment through the internal circulation of air in a confined space. The time for each heat-balance treatment is 5 minutes, and the quantity of each heat-balance treatment is 50 batches of bamboo shavings;

(6) Mixing glue: Feed bamboo shavings and glues to a mixer at a volume ratio of 1:0.18, and stir 3 minutes at a stirring speed of 100 rpm. The stirring quantity for 3 minutes each time is 60 kg, and materials after stirring are put into a bucket for standby;

(7) Paving and hot pressing: According to the size and specification of the tray, after metering and weighing, put materials in a mold for paving. The paving should at least fill the mold, and the upper surface of the mold is leveled, surplus materials are recycled, after paving, perform hot pressing, with an upper mold temperature of 150° C., lower mold temperature of 130° C. Firstly perform initial hot pressing for 150 seconds at a pressure of 10 mPaP, after the initial pressing, maintain hot pressing for 70 seconds at a pressure of 5 mPa, at the end of pressure holding, the pressure is relieved. The pressure relief refers to the process of reducing the pressure ‘’’’from the holding pressure to zero and the time of pressure relief is 90 seconds. Carry out cooling while relieving the pressure, and when the pressure relieving is finished, the temperature is dropped below 100° C.;

(8) Cooling and grinding: take out workpieces from the mold after pressure relief, and place to a rack for cooling. The rack is placed in a room temperature ventilation room, to avoid water. The indoor air humidity is 35%, and if the air humidity is too high, dehumidify and then place the workpieces. The rack is a high-temperature resistant multi-layer bracket. The spacing between each layer of bracket is 48 cm and the spacing between adjacent racks is 30 cm. The cooling time is 1 day, after cooling, the workpieces are delivered to an automatic edge grinding machine for grinding, and the edge grinding is required to remove or flatten the spiked portion of the workpiece edge;

(9) Inspecting and warehousing: Inspect the workpieces after grinding, including hardness, moisture content, edge roughness, and shape. Unqualified products are removed according to the finished product requirements. Qualified products are stacked in batches according to the required quantity.

A performance test is performed for molded trays manufactured in foregoing examples and comparative examples. Results are shown in the table below.

| | Size stability | Moisture content % | Product density kg/m$^3$ | Maximum dynamic loading capacity KG |
|---|---|---|---|---|
| Example 1 | Stable shape, no edge warp | 6 | 1800 | 3200 |
| Example 2 | Stable shape, | 4.8 | 2000 | 3500 |

-continued

| | Size stability | Moisture content % | Product density kg/m$^3$ | Maximum dynamic loading capacity KG |
|---|---|---|---|---|
| | no edge warp | | | |
| Example 3 | Stable shape, no edge warp | 7 | 1780 | 3160 |
| Comparative Example 1 | Slight edge warp | 8.5 | 1520 | 2210 |
| Comparative Example 2 | Stable shape, no edge warp | 8 | 1650 | 2500 |
| Comparative Example 3 | Slight edge warp | 7.5 | 1400 | 2300 |
| Comparative Example 4 | Stable shape, no edge warp | 4.5 | 1900 | 3060 |

The heat balance treatment is performed for 5-8 minutes in Examples 1-3. As described above, for the products after heat balance treatment, its temperature and moisture content of base material is basically the same, so high-quality products with large density, low moisture content and high maximum dynamic loading capacity can be manufactured. But in comparative example 1, since no heat balance treatment is performed, it is found that the proportion of products with slight edge warp is increased significantly in each batch of products, the overall moisture content of products is increased apparently, and the product density and maximum dynamic loading capacity are reduced apparently. The above results show that a heat balance treatment has a great influence on the product performance.

However, the time of heat balance treatment should not be too long, and the heat balance has a better time interval. In this embodiment, the most suitable time is about 6 minutes. The data in Example 2 show that, after 6-min heat balance treatment, the temperature and moisture balance of the product reach the best state (average degree); in addition, they are not affected by the external environment substantially within 6 minutes. Therefore, Example 2 gives a best embodiment. According to the data in Example 2, it is obviously showed that, in this preferred embodiment, the products have low moisture content, high density and their maximum dynamic loading capacity is obviously higher than that in other embodiments.

In contrast, 3-min and 10-min heat balance treatments are performed in comparative examples 2 and 3 respectively. If the time of heat balance treatment is not enough, it is obviously unable to achieve consistent performance of materials. The time of 3 minutes is too short, and it is unable to achieve complete exchange of moisture and temperature between products, and apparently it is unable to achieve good consistency. However, if the time is too long, after complete heat exchange or moisture balance, the products will be affected by external environment again. For example, the outer layer may absorb external moisture or have heat exchange with the external environment, to produce difference from the internal moisture and heat, resulting in inconsistent performance. Results from comparative examples 2 and 3 show that, if the heat balance time is too long or too short, the product performance is not as good as that under an appropriate heat balance time.

According to the results in the above table, the dimensional stability of molded trays after heat balance treatment is obviously better than that without heat balance treatment. The molded trays that are not subjected to heat balance treatment (for example, comparative example 1) may generate edge warps. In contrast, the heat balance treatment in example 2 achieves the best effect. In example 2, the time of heat balance treatment is most appropriate; therefore, the treated trays have low water content, high product density, and high strength for the same volume. In addition, according to the data in comparative examples 2 and 3, the heat balance treatment time cannot be too long or too short, otherwise it will affect the heat treatment effect. When the heat treatment time is not enough or is too long, the product quality will be affected.

In addition, the selected raw materials will also have an impact on product performance. The comparative example 4 provides an example of bamboo-wood mixed material. The parameters used in the processing in comparative example 4 are basically the same as those in example 1. By comparing with the comparative example 4, the products may present superiority in different performances when the raw material is bamboo-wood mixed material. For example, the pure bamboo shaving products may present superiority in density and moisture content, while the products of bamboo-wood mixed material may present superiority in maximum dynamic loading capacity.

The invention claimed is:

1. A method for processing a molded tray based on bamboo-wood mixed shavings, comprising the following steps in the order of: (1) extracting: collect scrap bamboo materials, remove bamboo peels and any materials other than bamboo and bamboo peels from scrap bamboo materials, and remove rotted or quasi-rotted bamboo materials with a moisture content of greater than 20%; collect scrap wood materials, remove impurities other than woods, and remove rotted or quasi-rotted wood materials with a moisture content of greater than 20%; (2) crushing: deliver the extracted bamboo materials to a crusher to crush into bamboo material segments with a length of no more than 5 cm, and then shave with a shaving machine to form bamboo shavings having length <30 mm, width <4 mm, and thickness <1.5 mm; cut the extracted wood materials into segments, with a length of no more than 10 cm, a width and a thickness of no more than 5 cm, cut the segments into wood shavings having length <30 mm, width <4 mm, and thickness <1.5 mm; (3) mixing: perform physical mixing of the crushed bamboo shavings and the crushed wood shavings at a mass ratio of 1:1, and the mixing process is to put mixture of the crushed bamboo shavings and the crushed wood shavings into a container, blow air to the container, and at the same time, stir the materials at a speed of 30 rpm using a stirring rod without sharp portion, continue the blowing and stirring for 8-10 minutes, so that the crushed bamboo shavings and the crushed wood shavings are evenly stirred; (4) drying: put the mixed shaving from the prior mixing step into trays that are resistant to at least 170° C., then dry in a drying oven, place the trays by layers in the drying oven, with a distance between two directly adjacent trays of not less than 38 cm, a stacking thickness of mixed shavings in each tray does not exceed 2.5 cm, a drying temperature is maintained at 160-170° C., a drying time is 25-30 min, and a moisture content of mixed shavings after drying does not exceed 1% in mass percent; (5) separating by wind separation: the dried mixed shavings are subjected to purification by cyclone separation and pulse dust removal, to remove the metal materials, gravels, coarse wood materials, powders and impurities which refer to any materials other than powders and mixed shavings from the prior drying step from the mixed shavings, to get mixed shaving materials with a mass purity greater than 96%; (6) heat balance treatment: place mixed shaving materials with a mass purity greater than 96% in a confined space in batches, with a thickness of each batch of no more than 5 cm, and a volume of each batch of no more than 0.5 cubic meter, the mixed shavings are placed as loosely as possible, the density of mixed shavings of each batch does not exceed 0.055 g/cm$^3$, and a spacing between each batch of mixed shavings does not exceed 20 cm, to facilitate the exchange of heat and moisture between each batch of mixed shavings, multiple batches of mixed shavings that are left at an indoor temperature are subjected to heat balance treatment through an internal circulation of air in the confined space, a time for the heat-balance treatment is 5 to 8 minutes, and a quantity for the heat-balance treatment is not less than 50 batches of mixed shavings; (7) mixing glue: feed mixed shavings from step (6) and glues to a mixer at a volume ratio of 1:0.2-0.25, and stir 3 minutes at a stirring speed of 100-200 rpm, a stirring quantity for 3 minutes each time does not exceed 80 kg, and mixture mixed shavings and glues after stirring are put into a bucket for later use; (8) paving and hot pressing: according to the size and specification of the tray, after metering and weighing, put a mixture of mixed shavings and glues in a bucket after stirring in a mold for paving, the paving should at least fill the mold, and the upper surface of the mold is leveled, surplus materials are recycled, after paving, perform hot pressing, with an upper mold which is heated to a temperature of 150° C., a lower mold which is heated to a temperature of 130° C., firstly perform initial hot pressing for 150 seconds at a pressure of 10 MPa, after the initial pressing, maintain hot pressing for 70 seconds at a pressure of 5 MPa, at the end of pressure holding, the pressure is relieved, the pressure relief refers to the process of reducing the pressure from the holding pressure to zero and the time of pressure relief is 90 seconds, carry out cooling while relieving the pressure, and when the pressure relieving is finished, the temperature of both molds is dropped to less than 100° C.; (9) cooling and grinding: take out workpieces made by the paving and hot pressing from the molds after pressure relief, and place to racks for cooling, the racks are placed in an indoor temperature ventilation room, to avoid water, an indoor air humidity is not more than 35%, and if an air humidity is higher than 35%, dehumidify and then place the workpieces to the racks which are multi-layer brackets, the spacing between each layer of brackets is not less than 48 cm and the spacing between two directly adjacent racks is not less than 30 cm, a cooling time is 1-2 days, after cooling, the workpieces are delivered to an automatic edge grinding machine for grinding, and the automatic edge grinding is required to remove or flatten a spiked portion of a workpiece edge; (10) inspecting and warehousing: inspect the workpieces after grinding, comprising hardness, moisture content, edge roughness, and shape, unqualified products are removed according to finished product requirements, qualified products are stacked in batches according to a required quantity.

* * * * *